US008839974B2

(12) United States Patent
Brandenburger et al.

(10) Patent No.: US 8,839,974 B2
(45) Date of Patent: Sep. 23, 2014

(54) CLOSURE CAP FOR A CONTAINER FILLED WITH A MEDICAL FLUID, AND CONTAINER HAVING A CLOSURE CAP

(75) Inventors: Torsten Brandenburger, Reichelsheim (DE); Christian Ebert, Frankfurt am Main (DE); Bernd Knierbein, Neu-Anspach (DE)

(73) Assignee: Fresenius Kabi Deutschland GmbH, Bad Homburg (DE)

( * ) Notice: Subject to any disclaimer, the term of this patent is extended or adjusted under 35 U.S.C. 154(b) by 0 days.

(21) Appl. No.: 13/640,323

(22) PCT Filed: Apr. 8, 2011

(86) PCT No.: PCT/EP2011/055518

§ 371 (c)(1),
(2), (4) Date: Nov. 7, 2012

(87) PCT Pub. No.: WO2011/128267

PCT Pub. Date: Oct. 20, 2011

(65) Prior Publication Data

US 2013/0048637 A1 Feb. 28, 2013

Related U.S. Application Data

(60) Provisional application No. 61/345,620, filed on May 18, 2010.

(30) Foreign Application Priority Data

Apr. 14, 2010 (DE) ..... 10 2010 015 002
May 17, 2010 (EP) ..... 10163030

(51) Int. Cl.

| | |
|---|---|
| ***B65D 17/42*** | (2006.01) |
| ***B65D 51/22*** | (2006.01) |
| ***B65D 41/04*** | (2006.01) |
| ***B65D 47/32*** | (2006.01) |
| ***B65D 47/06*** | (2006.01) |

(52) U.S. Cl.

CPC ..... *B65D 47/066* (2013.01); *B65D 2101/0038* (2013.01); *B65D 2251/0093* (2013.01); *B65D 51/224* (2013.01); *B65D 2251/0025* (2013.01); *B65D 41/0442* (2013.01); *B65D 47/32* (2013.01)

USPC ..... 220/212; 222/83; 220/255.1; 220/277; 220/265

(58) Field of Classification Search

USPC ..... 220/212, 255.1, 265, 278, 277, 220/708–709, 222; 222/81, 83; 215/253, 215/388, 228, 307

See application file for complete search history.

(56) References Cited

U.S. PATENT DOCUMENTS 5,961,010 A 10/1999 Smith
2005/0173454 A1 * 8/2005 Maas et al. ..... 222/81

(Continued)

FOREIGN PATENT DOCUMENTS

DE 10 2006 035761 2/2008
EP 1125854 8/2001

(Continued)

*Primary Examiner* — Anthony Stashick
*Assistant Examiner* — James Way
(74) *Attorney, Agent, or Firm* — Occhiuti & Rohlicek LLP

(57) ABSTRACT

A closure cap for a container filled with a medical fluid and having a mouthpiece sealed by a pierceable membrane includes a cap-shaped closure body and a drinking stub with an opening for drinking purposes. The drinking stub is pivotable between a first position, in which the drinking stub bears against the closure body, and a second position, in which the drinking stub protrudes from the closure body, such that, when the drinking stub is pivoted, the membrane of the container is pierced and a connection is produced between the opening in the drinking stub and the container interior.

18 Claims, 7 Drawing Sheets

(56) References Cited

U.S. PATENT DOCUMENTS

| | | | | |
|---|---|---|---|---|
| 2008/0128418 | A1* | 6/2008 | Ahn | 220/303 |
| 2012/0255952 | A1* | 10/2012 | Knierbein et al. | 220/278 |

FOREIGN PATENT DOCUMENTS

| | | |
|---|---|---|
| FR | 2789659 | 2/1999 |
| WO | WO 2006/057536 | 6/2006 |

* cited by examiner

CLOSURE CAP FOR A CONTAINER FILLED WITH A MEDICAL FLUID, AND CONTAINER HAVING A CLOSURE CAP

CROSS REFERENCE TO RELATED APPLICATIONS

This application is the national phase of international application no. PCT/EP2011/055518, filed Apr. 8, 2011, which claims priority to German Application no. 10 2010 015 002.9, filed Apr. 14, 2010, European application no. 10163030.9, filed May 17, 2010, and U.S. provisional application No. 61/345,620, filed May 18, 2010. The contents of the aforementioned applications are incorporated herein in their entirety.

TECHNICAL FIELD

The invention relates to a closure cap for a container which is filled with a medical fluid, in particular a fluid for enteral nutrition, and has a mouthpiece sealed by a pierceable membrane. Furthermore, the invention relates to a container for receiving a medical fluid, in particular an enteral nutrient solution, which container has a mouthpiece sealed by a pierceable membrane, whereby the mouthpiece of the container is closed with a closure cap of this type.

PRIOR ART

For enteral nutrition, liquid nutrient solutions are provided in containers, for example bottles or bags. It is known to fill the medical containers for receiving the enteral nutrient solutions aseptically. When filling bottles, it is also known to seal the mouthpiece of the container with a membrane, for example an aluminum foil or plastics film.

After pulling off the sealing foil/film, the contents of the nutrient solution container can be poured into a drinking vessel, or the container can be drunk from directly. In general, however, straws with which the sealing foil/film is pierced are used for drinking. However, drinking with a straw has certain disadvantages. Nutrient solution containers opened with straws are not closable again, and therefore there is the risk of the contents being able to flow out due to incorrect handling. Furthermore, drinking from non-collapsible containers, for example from plastics bottles or from the containers which are also referred to as TetraPak, is frequently not simple since the container is not sufficiently ventilated. The piercing of the sealing foil/film with a straw and drinking with the straw are frequently no longer possible particularly for weakened, old and/or ill individuals.

U.S. Pat. No. 5,961,010 A discloses a closure system which has a drinking stub which can be set upright and which is also referred to as a drinking beak or drinking spout. However, the known closure system does not have any device for piercing a sealing foil/film. Ventilation of the container closed with the closure system is also not provided.

EP 1125854 A describes a closure cap with a pivotable pouring spout which is designed as a piercing spike. When the pouring spout is set upright, a membrane arranged in the closure cap is pierced. However, the known closure cap is not intended to be screwed onto a container already sealed with a sealing foil/film. On the contrary, the pierceable membrane is part of the closure cap. Furthermore, the known closure cap does not provide ventilation.

FR 2789659 A discloses a closure cap which is not designed as a screw cap and has a pouring spout which, upon being set upright, pierces a sealing foil/film. This closure cap does not provide ventilation either.

WO 2006/057536 A describes a film/foil-sealed bottle with a closure cap which has a drinking stub. It again proves to be disadvantageous that ventilation of the bottle is not provided. This makes handling more difficult, in particular for weakened individuals.

DE 102006035761 A discloses a closure cap with a pivotable drinking stub, said closure cap being screwed onto a container, the mouthpiece of which is closed by a membrane. The membrane is pierced when the drinking stub is set upright. It is disadvantageous that the drinking stub is not reclosable after the membrane is pierced.

BRIEF DESCRIPTION OF THE INVENTION

The invention is based on the object of providing a closure cap which is simple to handle in particular for weakened individuals and which can be used to reclose a container which is filled with a medical fluid, in particular an enteral nutrient solution, and the mouthpiece of which is closed with a pierceable membrane. In this case, the forces for opening and closing the closure cap are intended to be relatively small. It is a further object of the invention to provide a container which is simple to handle and has a closure cap of this type.

These objects are achieved by the features of the independent patent claims. The dependent claims relate to advantageous embodiments of the invention.

The closure cap according to the invention has a cap-shaped closure body and a drinking stub with an opening for drinking purposes, said drinking stub being pivotable between a first position, in which the drinking stub bears against the closure body, and a second position, in which the drinking stub protrudes from the closure body, such that, when the drinking stub is pivoted, the membrane of the container is pierced and a connection can be produced between the opening in the drinking stub and the container interior. Furthermore, the closure cap has a ventilation stub with an opening for ventilating the container during drinking.

In the case of the closure cap according to the invention, the drinking stub and the ventilation stub are arranged on the closure body in such a manner, and the drinking stub and ventilation stub are designed in such a manner, that the drinking stub is closed by the ventilation stub in the first position, in which the drinking stub bears against the closure body, and is opened in the second position, in which the drinking stub protrudes from the closure body. The effect achieved by this is that the closure cap can be reclosed after use.

In a preferred embodiment of the invention, the inner endpiece of the ventilation stub is designed as a shut-off body closing the drinking stub, and the inner endpiece of the drinking stub is designed as a valve seat, wherein, in the first position, in which the drinking stub bears against the closure body, the shut-off body sits on the valve seat. The bearing surfaces of drinking and ventilation stubs may be designed differently. The sole crucial factor is that the two parts are sealed off from each other such that, even after the membrane is pierced, liquid cannot escape.

The pivot axis about which the drinking stub is pivoted between the first position and second position is preferably arranged below the lid part, preferably on the ventilation stub. With the extension of the lever arm by shifting the rotation point, the forces required for raising the drinking stub are reduced, and therefore the drinking stub can be flipped upwards more easily.

The inner endpiece of the drinking stub preferably has a tubular section to which a shell-shaped section is connected.

The means for piercing the membrane are preferably a piercing spike which is formed on the shell-shaped section of the inner endpiece of the drinking stub.

In a further particularly preferred embodiment of the invention, not only is the drinking stub reclosable but also the ventilation stub is closable. However, it is, in principle, also possible for only the ventilation stub, but not the drinking stub to be closable. In this embodiment, the drinking stub and the ventilation stub are arranged on the closure body in such a manner, and the drinking stub and ventilation stub are designed in such a manner that, in the first position, in which the drinking stub bears against the closure body, the ventilation stub is closed by the drinking stub, and is opened in the second position, in which the drinking stub protrudes from the closure body. In this case, that the inner endpiece of the drinking stub is designed as a shut-off body closing the ventilation stub, and the ventilation stub is designed as a valve seat, wherein, in the first position, in which the drinking stub bears against the closure body, the shut-off body sits on the valve seat.

The handling of the closure cap is preferably furthermore simplified in that, in the first position, in which the drinking stub bears against the closure body, the drinking stub is inclined in relation to the lid part of the closure body so as to form a sufficiently wide recessed grip between the edge part of the closure body and the outer endpiece of the drinking stub.

The production of the closure cap according to the invention is preferably simplified by the fact that the drinking stub is an integral part of the closure body. It is therefore possible to produce the closure cap cost-effectively in a single-stage production process. For this purpose, the closure body is preferably weakened in the region of the foot part of the drinking stub in such a manner that the drinking stub which is integrally formed on the closure body is pivotable between the first position and second position. For this purpose, the drinking stub may be connected to the closure body by a film hinge. In the first position, the drinking stub is secured on the closure body against unintentional opening of the closure cap preferably by a tamper-evident closure. The tamper-evident closure may be a tab which can be torn off from the closure body and can engage over a lug projecting from the drinking stub. In order to open the closure cap, the closure tab therefore merely needs to be torn off and the drinking stub set upright. However, it is also possible to connect the drinking stub in the first position to the closure body via a weakening zone which tears open when the stub is set upright.

In a further preferred embodiment of the closure cap according to the invention, the drinking stub is arranged in the first position in a recess or depression of the lid part of the closure body. As a result, the drinking stub is not annoyingly obvious. The drinking stub is preferably fixed in a latching manner in the depression for reclosure purposes.

The edge part of the closure body preferably has an upper section receiving the drinking stub and the ventilation stub. In order to be able to screw the closure body onto a container with screw connection, the edge part of the closure body preferably has a lower section with an internal thread. However, the closure cap does not necessarily have to be designed as a screw cap.

The dropping strength of the container with the closure cap is preferably increased by the lower section of the edge part of the closure body being connected via an outwardly projecting shoulder to the upper section of the edge part of closure body. With the cap edge drawn in, the cap can be better supported on the edge of the container and the pierceable membrane can be supported by the cap edge.

While the closure cap according to the invention is preferably an injection molded part made of plastic, in particular of polypropylene or polyethylene, the container is preferably produced by injection blow molding or extrusion blow molding.

The edge part of the closure body may also have a tamper-evident closure which is preferably a closure ring integrally formed on the edge part via a weakening zone. By means of the torn-off closure ring, it can then be recognized that the closure cap has been removed from the container.

A preferred embodiment of the closure cap is characterized in that the drinking stub and the ventilation stub are an integral part of the closure body.

A further preferred embodiment of the closure cap is characterized in that the edge part of the closure body has an upper section receiving the drinking stub and the ventilation stub.

A further preferred embodiment of the closure cap is characterized in that the edge part of the closure body has a lower section with an internal thread.

A further preferred embodiment of the closure cap is characterized in that the lower section is connected via an outwardly projecting shoulder to the upper section of the edge part of the closure body.

A further preferred embodiment of the container is characterized in that the container is a bottle.

An exemplary embodiment of the invention is explained in more detail below with reference to the drawings.

DESCRIPTION OF THE EMBODIMENTS

The following is a description, with reference to FIGS. 1 to 5, of an exemplary embodiment of the closure cap according to the invention, which is designed as a screw cap and is screwed onto a bottle with a screw closure and which is closed by a membrane. FIG. 6 shows the bottle without a screw closure.

Figure 1:
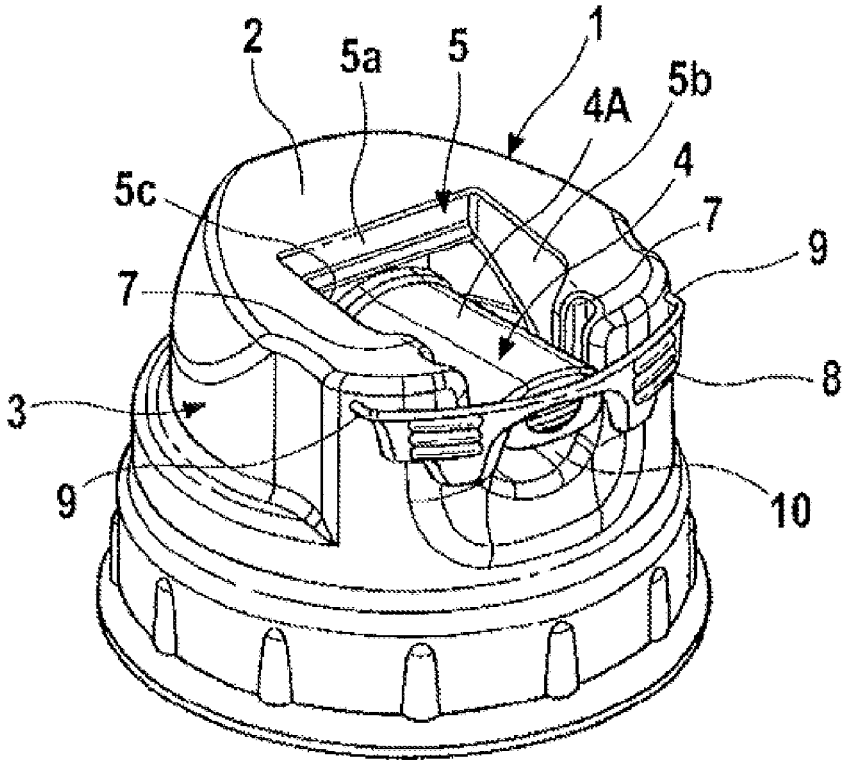
FIG. 1 shows a view of the closure cap according to the invention in a perspective illustration before the drinking stub is set upright.
Figure 2:
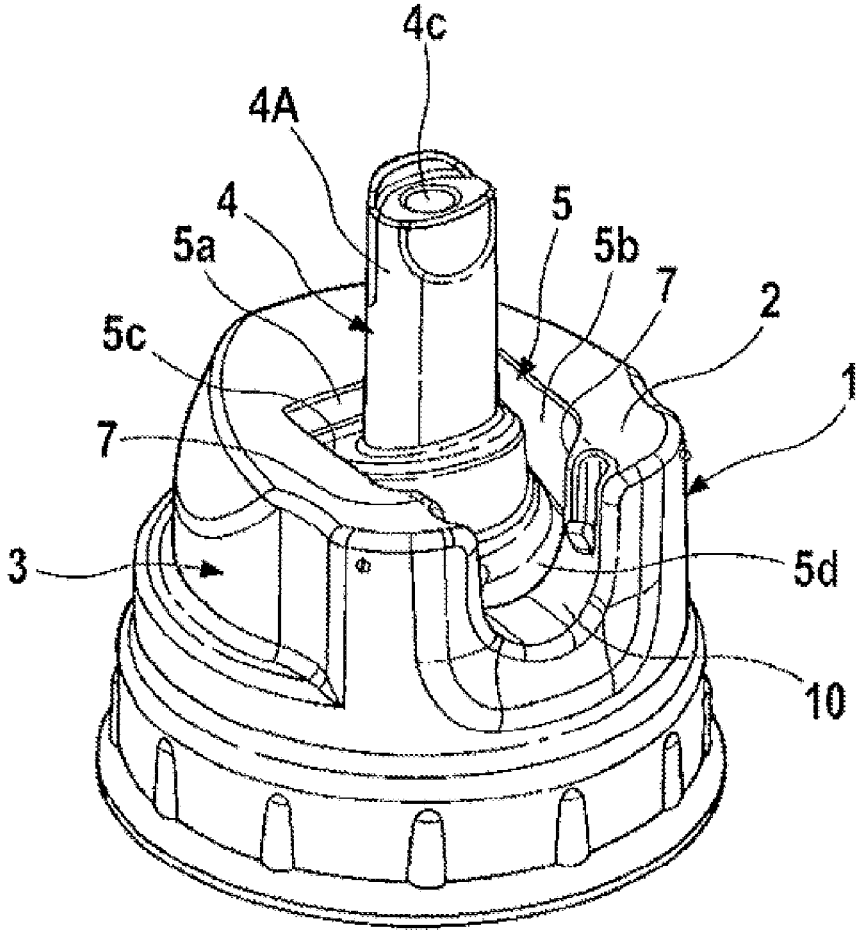
FIG. 2 shows a perspective illustration of the closure cap according to the invention from FIG. 1 after the drinking stub is set upright.
Figure 3:
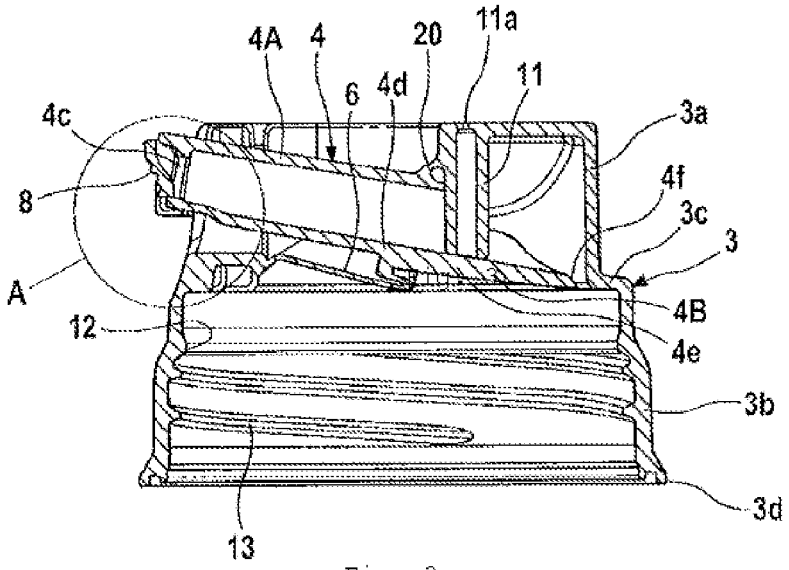
FIG. 3 shows the closure cap before the drinking stub is set upright, in a sectional illustration.
Figure 4:
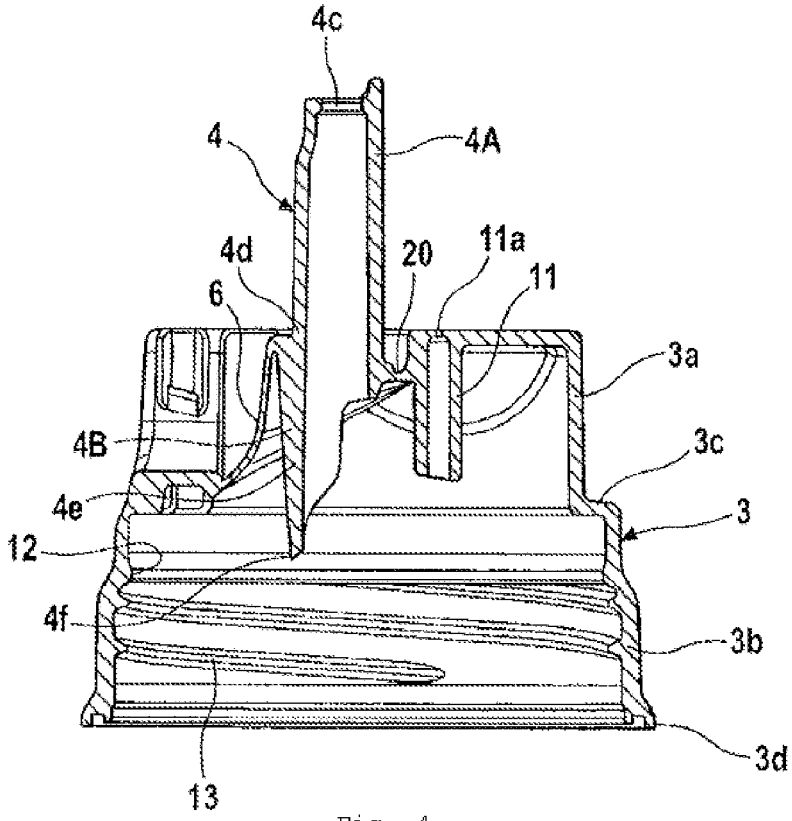
FIG. 4 shows the closure cap after the drinking stub is set upright, in a sectional illustration.

The closure cap is a plastic injection molded part preferably made of polypropylene or polyethylene. It has a cap-shaped closure body 1 with a lid part 2 and a substantially cylindrical edge part 3. A drinking stub 4 (drinking spout, drinking beak) is integrally formed on the closure body 1 and can be pivoted from a first position, in which the drinking stubs bears against the closure body 1 (FIG. 1 and FIG. 3), into a second position, in which the drinking stub protrudes from the closure body (FIG. 2 and FIG. 4). The drinking stub 4 can be pivoted through approx. 80° on the closure body.

The lid part 2 of the closure body 1 has a depression 5 with a central side part 5*a*, two opposite, outwardly extending side parts 5*b*, 5*c* and a bottom part 5*d* which is penetrated by the drinking stub 4.

The drinking stub 4 is a substantially tubular body which has an outwardly pointing outer endpiece 4A with an opening 4*c* for drinking purposes and an inwardly pointing inner endpiece 4B. The outer endpiece 4A of the drinking stub 4 has an oval cross section in order, with the mouth, easily to be able to enclose the stub. The dimensions of the depression 5 substantially correspond to those of the outer section 4A of the drinking stub 4, and therefore the drinking stub can be folded onto the closure body without protruding upward or to the side. The inner endpiece 4B of the drinking stub 4 has a tubular section 4*d* to which a shell-shaped section 4*e* designed as a piercing spike 4*f* is connected. The length of the drinking stub 4 is dimensioned in such a manner that, when the drinking stub is set upright, the pointed end thereof pierces the membrane of the bottle when the closure cap is screwed onto the bottle. The drinking stub has sufficient rigidity such that it is not deflected when piercing the membrane. The required rigidity of the drinking stub can be ensured by sufficient dimensioning of the material thickness and/or by the shaping of the stub.

The single-part closure cap 1 is injection molded with the drinking stub 4 set upright. Immediately after the injection molding, the drinking stub 4 set upright is bent through approx. 80° such that the outer section 4A thereof lies in the depression 5. A material weakening in the region of the bottom part 5*d* of the depression 5 is connected to said section, thus producing a weakening zone 6 which encloses the foot part of the drinking stub and permits a pivoting movement of the drinking stub through approx. 80°. However, instead of a weakening zone, a film hinge may also be provided.

Two opposite lugs 7 which secure the drinking stub 4 in the depression for reclosure purposes are integrally formed on the opposite side surfaces 5*b* and 5*c* of the depression 5. An additional securing means forms a tamper-evident closure 8 on the side of the closure cap. The tamper-evident closure 8 is a plastics tab which is integrally formed on the upper section of the edge part 3 of the closure body 1 via weakening zones 9 on both sides. The tear-off tab 8 partially closes the lateral opening 10 in the depression 5.

In order to set the drinking stub 4 upright, the tear-off tab 8 is torn off, wherein the weakening zones 9 tear open. The drinking stub 4 which is fixed in a latching manner in the depression 5 is then set upright, wherein the material of the closure body 1 is deformed in the region of the bellows region 5*d* of the drinking stub or of the bottom part of the depression 5.

In order to ventilate the container, a ventilation stub 11 arranged next to the drinking stub 4 is provided. The ventilation stub 11 is a substantially tubular body which is integrally formed on the inside of the lid part 2 of the closure body 1. The ventilation stub 11 has a ventilation opening 11*a* on the lid part 2.

The edge part 3 of the closure body 1 has an upper section 3*a* receiving the drinking stub 4 and the ventilation stub 11 and a lower section 3*b* which is connected to the upper section via an outwardly projecting shoulder 3*c* such that the edge part 3 is drawn in.

Below the outwardly projecting shoulder 3*c*, an internal thread 13 having a pitch which corresponds to the pitch of the external thread of the mouthpiece of the container is located on the inside of the lower section 3*b* of the edge part 3.

FIG. 6 shows the container 14 onto which the closure cap is screwed. The bottle produced by injection blow molding or extrusion blow molding is filled aseptically with an enteral nutrient solution. The bottle (preform) produced in two working steps in the case of injection blow molding has an inflated bottle body 15 with an injection molded mouthpiece 16. After the bottle is filled, the mouthpiece 16, which has an external thread 17, is sealed with a pierceable membrane 18, for example an aluminum foil. The aluminum foil serves to close the container 14 in a gas-tight manner is it were (barrier) and aseptically. Above the external thread 17, the outside of the mouthpiece 16 has a cylindrical sealing surface 19 which comes into contact in a sealing manner with the cylindrical sealing surface 12 of the edge part 3 of the closure body 1 when the closure cap is screwed on.

Figure 7:
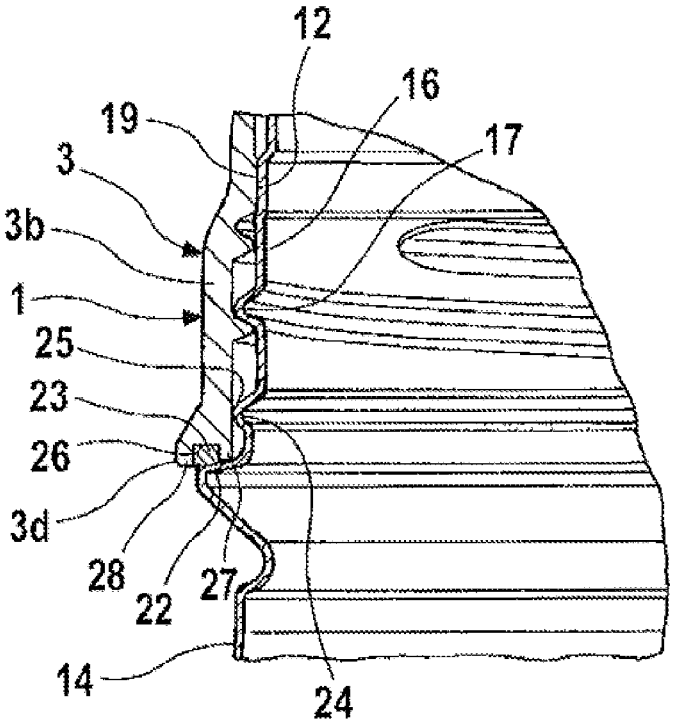

FIG. 7 shows the cylindrical edge part 3 of the closure body 1 together with the mouthpiece 16 of the bottle body 15. Below the bottom part 5*d* of the depression 5 on the inside, the upper section 3*a* of the edge part 3 of the closure body 1 has the cylindrical sealing surface 12, with which the closure cap 1 is sealed off from the corresponding cylindrical sealing surface 19 on the outside of the mouthpiece 16 of the bottle body 15. In addition to the first, upper radial seal, a second, lower radial seal is provided, said seal being formed by a radially outwardly protruding, encircling lug 24 on the mouthpiece 16 of the bottle body 1 and a likewise cylindrical sealing surface 25, which is opposite the lug 24, on the inside of the lower section 3*b* of the edge part 3 of the closure cap 1. The outwardly protruding lug 24 protrudes slightly over the external thread 17 of the mouthpiece 16 of the container 14, such that an adequate press-on pressure is obtained. In addition to the two radial seals, an axial seal is also provided. The lower edge 3*d* of the edge part 3 is sealed off from the inner toothed edge 22 of the thread 17 of the mouthpiece 16 when the closure cap is screwed onto the bottle. In this case, a seal 23 can be provided on the lower edge 3*d* of the edge part 3, said seal providing sealing in relation to the upper side of the inner toothed edge 22. In the exemplary embodiment, the seal 23 lies in a groove 26 on the lower side of the lower edge 3*d* of the edge part 3, wherein the remaining inner web 27 rests on the inner toothed edge 22 while the remaining outer web 28 of the lower edge 3*d* lies in front of the inner toothed edge 22 of the thread 17.

The upper side of the closure cap and the bottom part of the bottle are designed in such a manner that the closed bottles can be stacked one above another and therefore stored and transported with a high packing density.

The container which is filled with enteral nutrient solution is generally supplied with the closure cap screwed on, wherein the drinking stub 4 lies within the depression 5. In order to remove the nutrient solution, the tear-off tab 8 is torn off, and the drinking stub 4 is set upright. During the setting upright operation, the piercing spike 4*f* of the drinking stub 4 pierces the membrane 18 with which the mouthpiece 16 of the container is sealed. Since the container is adequately ventilated via the ventilation stub 11, the container generally drains by itself, wherein air flows through the ventilation opening 11*a* in the ventilation stub 11 into the container interior. However, in the case of very viscous fluids, it may be necessary to assist the drainage by sucking on the drinking stub and/or pressing the container.

The drinking stub 4 is integrally formed in a pivotable manner on the closure body 1 via the weakening zone in such a manner that the pivot axis 20 of the drinking stub lies below the lid part 2 on that side of the ventilation stub 11 which faces the drinking stub. If the drinking stub 4 is folded onto the closure body 1, the ventilation stub 11 closes the drinking stub 4 and the drinking stub closes the ventilation stub. The closure cap can therefore be reclosed after the fluid is removed, and therefore fluid cannot escape from the container even if the membrane of the container has already been pierced.

The tubular section 4*d* of the inner endpiece 4B of the drinking stub 4 is designed as a valve seat on the side facing the ventilation stub 11, while the ventilation stub 11 is designed, on the side facing the drinking stub 4, as a shut-off body which sits on the valve seat when the drinking stub is folded up. The drinking stub is therefore closed by the ventilation stub.

Furthermore, the shell-shaped section 4*e* of the inner endpiece 4B of the drinking stub is designed as a shut-off body on the side facing the ventilation stub 11, while the ventilation stub 11 is designed as a valve seat on the side facing the drinking stub 4, and therefore the ventilation stub is closed by the drinking stub.

The drinking stub 4 and ventilation stub 11 are formed on the mutually facing sides in such a manner that the contours correspond to each other for a closure which is as tight as possible.

In the folded-up position, the drinking stub 14 is inclined slightly in relation to the lid part 2 of the closure body 1. In this case, the longitudinal axis of the drinking stub encloses an angle of between 8 and 12°, preferably 10°, with the upper side of the lid part. The slight inclination of the drinking stub 4 provides a sufficiently wide recessed grip 21 which is formed between the edge part 3 of the closure body 1 and the outer endpiece 4A of the drinking stub 4.

Figure 5:
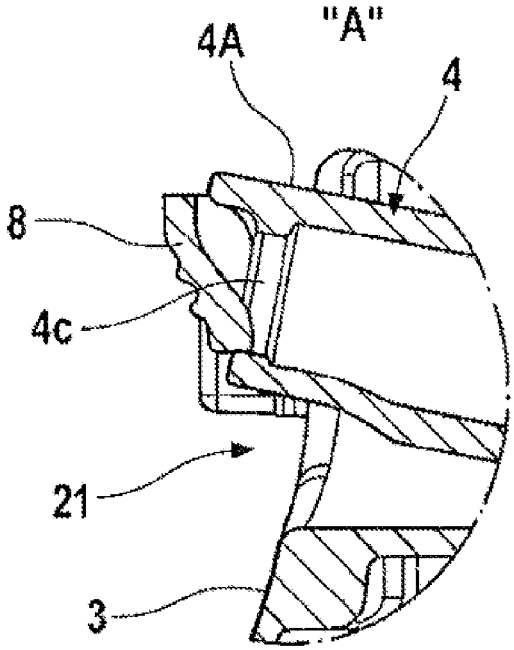
FIG. 5 shows the detail A from FIG. 3 in an enlarged illustration.
Figure 6:
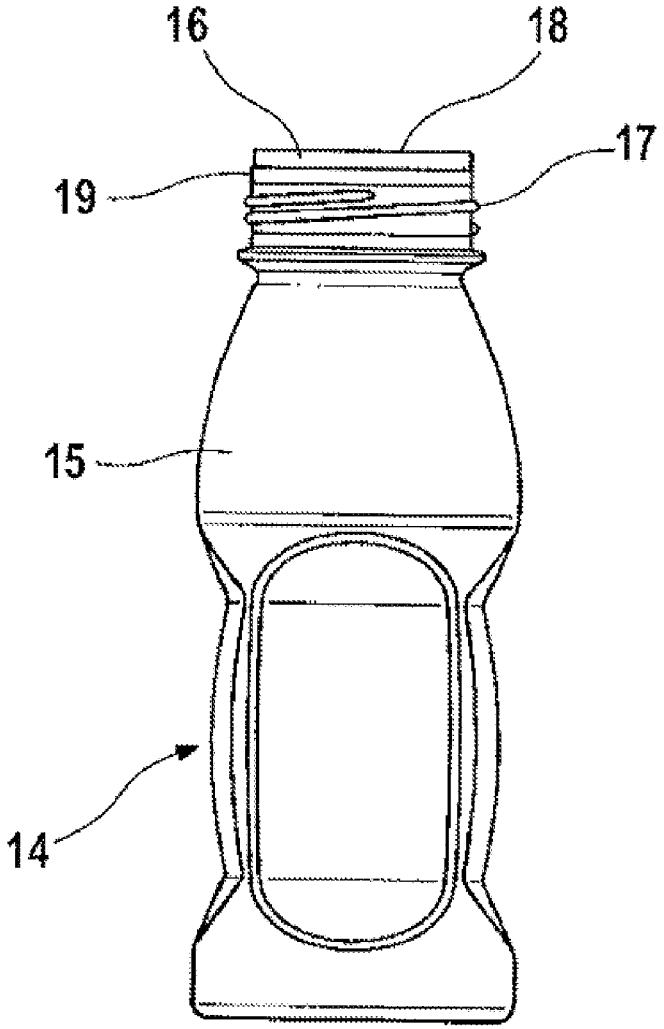
FIG. 6 shows the container without a closure cap in side view and FIG. 7 shows the edge part of the closure body together with the mouthpiece of the bottle body.

FIG. 5 shows the recessed grip 21 on the closure body below the drinking stub.

The arrangement of the pivot axis 20 of the drinking stub 4 below the lid part 2 on the ventilation stub 11 in conjunction with the slight inclination of the drinking stub in the folded-up position reduces the forces required for setting the drinking stub upright, while the enlarged recessed grip 21 facilitates the grasping of the drinking stub with the finger. This improves the handling of the closure cap.

The invention claimed is:

1. A closure cap for a container which is filled with a medical fluid and has a mouthpiece sealed by a pierceable membrane, comprising a cap-shaped closure body which has a lid part and an edge part, a drinking stub disposed on the lid part and having an outer endpiece and an inner endpiece, the outer endpiece having an opening for drinking purposes, the inner endpiece having a piercing member configured to puncture the membrane, and a ventilation stub having an opening for ventilating the container during drinking, wherein the drinking stub is pivotable, relative to the ventilation stub, between a first position, in which the drinking stub bears against the closure body, and a second position, in which the drinking stub protrudes from the closure body, such that, when the drinking stub is pivoted, the membrane is pierced and a connection is produced between the opening in the drinking stub and the container interior, wherein the drinking stub is closed by the ventilation stub in the first position, in which the drinking stub bears against the closure body, and the drinking stub is opened in the second position, in which the drinking stub protrudes from the closure body.

2. The closure cap as claimed in claim 1, wherein the ventilation stub is designed as a shut-off body closing the drinking stub, and the inner endpiece of the drinking stub is designed as a valve seat, wherein, in the first position, in which the drinking stub bears against the closure body, the shut-off body sits on the valve seat.

3. The closure cap as claimed in claim 1, wherein the ventilation stub is closed by the drinking stub in the first position, in which the drinking stub bears against the closure body, and the ventilation stub is opened in the second position, in which the drinking stub protrudes from the closure body.

4. The closure cap as claimed in claim 1, wherein the inner endpiece of the drinking stub is designed as a shut-off body closing the ventilation stub, and the ventilation stub is designed as a valve seat, wherein, in the first position, in which the drinking stub bears against the closure body, the shut-off body sits on the valve seat.

5. The closure cap as claimed in claim 1, wherein the pivot axis about which the drinking stub is pivoted between the first position and second position is arranged below the lid part of the closure body.

6. The closure cap as claimed in claim 1, wherein the pivot axis about which the drinking stub is pivoted between the first position and second position is arranged on the ventilation stub.

7. The closure cap as claimed in claim 1, wherein the inner endpiece of the drinking stub has a tubular section to which a shell-shaped section is connected.

8. The closure cap as claimed in claim 7, wherein the shell-shaped section of the inner endpiece of the drinking stub is designed as the shut-off body for the ventilation stub.

9. The closure cap as claimed in claim 7, wherein the tubular section of the inner endpiece of the drinking stub is designed as the valve seat for the ventilation stub.

10. The closure cap as claimed in claim 7, wherein the means for piercing the membrane are a piercing spike which is formed on the shell-shaped section of the inner endpiece of the drinking stub.

11. The closure cap as claimed in claim 1, wherein, in the first position, in which the drinking stub bears against the closure body, the drinking stub is inclined in relation to the lid part of the closure body so as to form a recessed grip between the edge part of the closure body and the outer endpiece of the drinking stub.

12. The closure cap as claimed in claim 1, wherein, in the first position, in which the drinking stub bears against the closure body, the drinking stub is secured on the closure body by a tamper-evident closure part.

13. The closure cap as claimed in claim 1, wherein, in the first position, in which the drinking stub bears against the closure body, the lid part of the closure body has a recess for receiving the drinking stub.

14. The closure cap as claimed in claim 13, wherein the drinking stub is fixed in a latching manner in the depression.

15. A container for receiving a medical fluid, which container has a mouthpiece sealed by a pierceable membrane, wherein the mouthpiece of the container is closed with a closure cap as claimed in claim 1.

16. The closure cap as claimed in claim 1, wherein the ventilation stub is a substantially tubular body integrally formed on the inside of the lid part.

17. The closure cap as claimed in claim 1, wherein the closure cap is formed of injection-molded plastic.

18. The closure cap as claimed in claim 17, wherein the closure cap is formed of an injection-molded plastic selected from a group including polypropylene or polyethylene.

* * * * *